US011529824B2

(12) United States Patent
Duffy et al.

(10) Patent No.: US 11,529,824 B2
(45) Date of Patent: Dec. 20, 2022

(54) PEN WITH MULTIPLE COLORS

(71) Applicant: SOCIETE BIC, Clichy (FR)

(72) Inventors: David Michael Duffy, Zurich (CH); Bernadette Elliott-Bowman, Leatherhead (GB)

(73) Assignee: SOCIÉTÉ BIC, Clichy (FR)

( * ) Notice: Subject to any disclaimer, the term of this patent is extended or adjusted under 35 U.S.C. 154(b) by 0 days.

(21) Appl. No.: 17/320,289

(22) Filed: May 14, 2021

(65) Prior Publication Data

US 2021/0387470 A1 Dec. 16, 2021

(30) Foreign Application Priority Data

Jun. 12, 2020 (EP) ..... 20315304

(51) Int. Cl.
*B43K 5/02* (2006.01)
*B43K 5/18* (2006.01)
*B43K 5/04* (2006.01)

(52) U.S. Cl.
CPC ..... *B43K 5/025* (2013.01); *B43K 5/04* (2013.01); *B43K 5/189* (2013.01); *B43K 5/1827* (2013.01)

(58) Field of Classification Search
CPC ..... B43K 5/025; B43K 5/1818; B43K 5/189
See application file for complete search history.

(56) References Cited

U.S. PATENT DOCUMENTS

| | | | | |
|---|---|---|---|---|
| 3,947,136 | A * | 3/1976 | Adams | B05B 11/0035 401/188 A |
| 5,911,533 | A | 6/1999 | Fassler et al. | |
| 6,749,355 | B2 * | 6/2004 | Payne | B43K 29/00 347/109 |
| 7,665,923 | B2 * | 2/2010 | Py | G01F 11/025 401/265 |
| 10,696,087 | B1 * | 6/2020 | Maresh | B43K 8/003 |
| 2003/0123921 | A1 | 7/2003 | Abbas | |
| 2010/0061793 | A1 | 3/2010 | Bender et al. | |
| 2019/0275827 | A1 * | 9/2019 | Nguyen | B43K 5/18 |

FOREIGN PATENT DOCUMENTS

CN 110281674 A 9/2019

OTHER PUBLICATIONS

Extended European Search Report dated Nov. 9, 2020 in European Patent Application No. 20315304.4 (8 pages, in English).

* cited by examiner

*Primary Examiner* — David P Angwin
*Assistant Examiner* — Bradley S Oliver
(74) *Attorney, Agent, or Firm* — Bookoff McAndrews, PLLC

(57) ABSTRACT

A writing instrument, in particular a pen, comprising at least two reservoirs for storing colorants or inks of at least two different colors, characterized by at least one pumping means which is designed to be actuated by at least one finger of a user.

20 Claims, 7 Drawing Sheets

PEN WITH MULTIPLE COLORS

This application claims priority from the European patent application No. 20315304.4, filed Jun. 12, 2020, its content being incorporated herein by reference.

TECHNICAL FIELD

The present disclosure relates to the field of writing instruments, in particular pens for providing multiple colors.

TECHNICAL BACKGROUND

A microfluidic pen for selectively writing lines of different colors is known from U.S. Pat. No. 5,911,533. This pen comprises reservoirs of different colorants, a mixing chamber and a micro-computer for controlling the actuation of microswitches so that a certain amount of the different colorants is supplied to the mixing chamber.

The object of the present disclosure is to provide an alternative writing instrument for providing different colors. Another object of the present disclosure is to provide a writing instrument for providing different colors which has reduced complexity and/or which can be manufactured more cost-efficiently.

SUMMARY

The present disclosure relates to a writing instrument as defined in claim 1. The dependent embodiments depict advantageous embodiments of the present disclosure.

A writing instrument according to the present disclosure, in particular a pen, comprises at least two reservoirs for storing colorants or inks of at least two different colors and at least one pumping means which is designed to be actuated by at least one finger of a user. The at least one pumping means is more specifically designed to provide a pumping actuation by using a force or pressure exerted by the at least one finger. This means that the energy introduced by the at least one finger into the at least one pumping means is directly used to actuate the at least one pumping means. With that, it is possible to design a multiple color pen which does not comprise a micro-computer or a micro-chip for actuating and/or controlling the operation of the pumping means. As a result, a battery for such a micro-computer or a micro-chip is not needed either. However, it should be understood that a battery and a micro-computer or micro-chip may be present for other purposes, for example for actuating a laser and/or a lamp which may be included in the writing instrument.

As will be described in detail below, a single pumping means can be used for pumping colorants or inks out of the at least two reservoirs (more specifically three or four reservoirs) each containing colorants/inks of a different color (more specifically three or four different colors). This single pumping means may be in fluid connection with all reservoirs such that inks/colors of different colors can be pumped by means of the actuation of a single finger. In this case, the color to be applied on a writing surface (in particular paper) can be selected by means of valves, wherein each valve is arranged between a respective reservoir and the pumping means. The opening and closing of the valves can be controlled by a color selecting means, in particular a ring on the writing instrument having internal protrusions for selectively closing the respective valves.

On the other hand, multiple pumping means are also possible according to the present disclosure, wherein each pumping means is assigned to a single reservoir for providing a single colorant or ink stored in that reservoir, i.e. one pumping means may be provided for each reservoir. In this case, one pumping means can only supply an ink/color of a single reservoir. If a mixture of inks/colorant is desired, the user has to actuate two or more pumping means at the same time.

Each pumping means may comprise a pumping chamber having a volume which can be reduced by using a force or pressure exerted by the at least one finger. In particular, each pumping means may comprise a flexible membrane or element which can be pressed into the pumping chamber by a force or pressure exerted by the at least one finger. With that, each flexible membrane or element changes its shape from a first shape to a second shape when a force or pressure is exerted by the at least one finger, thereby reducing the volume of the pumping chamber. The flexible membrane is more specifically designed to adopt its first shape after the force or pressure exerted by the at least one finger has been removed, thereby increasing or restoring the volume of the pumping chamber, in particular to its original volume prior to the actuation by at least one finger of a user.

The writing instrument of the present disclosure may comprise a mixing chamber which is designed to supply a single colorant/ink or to supply a mixture of colorants/inks of different colors, dependent on the actuation of the at least one finger of the user.

Each pumping means may comprise at least one valve, more specifically a self-actuated check valve (for blocking flow of ink/colorant in the reverse direction, also called "backflow"). For example, each pumping means may comprise a first valve, in particular a self-actuated first check valve, which is arranged between the pumping chamber of the pumping means and the mixing chamber. Alternatively or in addition, each pumping means may comprise a second valve, in particular a second self-actuated check valve, which is arranged between the reservoir or reservoirs which is/are in fluid connection with the pumping means, and the pumping chamber of the pumping means.

The writing instrument more specifically comprises tip for applying a respective colorant or ink, or a mixture of colorants or inks onto a writing surface (in particular a paper surface), wherein the tip is in fluid communication with the mixing chamber.

In case of at least two pumping means, the writing instrument of the present disclosure comprises buttons and/or finger actuation areas designed to actuate one, two or more pumping means by the force or pressure applied by the at least one finger. A color indicator may be provided which indicates to a user which button or finger actuation area or which buttons or finger actuation areas need to be actuated for selecting a specific color or mixture of colors.

As mentioned before, a pumping means may be arranged between the reservoir(s) and the mixing chamber. In this case, the pumping means applies a lower pressure compared to the pressure in the reservoir(s) in order to pump the colorant/ink by suction. However, it is also possible to use at least one pumping means for increasing the pressure in the at least two reservoirs. In particular, a single pumping means may be used for pumping air into the reservoirs in order to increase the pressure in the reservoir, wherein each valve means can be opened by using a force or pressure exerted by at least one finger as mentioned before.

In this case, each reservoir more specifically comprises at least one valve arranged between the respective reservoir and a mixing chamber for controlling the outflow of the inks/colorants of the respective reservoirs. A color selecting means may again be provided which is designed to partially or fully open one or more valves, and an indicator means for indicating the position of the selecting means for selecting a specific color or mixture of colors, respectively.

The mixing chamber may have a variable volume which can be varied by a user. With that, the amount of an ink/colorant mixture can be selected for a particular writing actuation (large volume in case of a longer writing actuation; small volume, if the writing instrument should be more responsive to a desired quicker change of color).

The fluid channels between the reservoirs and the at least one pumping means and the fluid channels between the pumping means and the mixing chamber preferable have a cross-section ranging from 0.01 to 0.25 $\mu m^2$, in particular from 0.05 to 0.2 $\mu m^2$.

The writing instrument may comprise two, three or four reservoirs, each storing a colorant or ink of a different color. More specifically, the reservoirs separately store colorants or inks of the colors red, green, blue and/or black, respectively, or wherein the reservoirs separately store colorants or inks of the colors yellow, red, blue and/or black, or wherein the reservoirs separately store colorants or inks of the colors cyan, magenta, yellow and/or black, respectively.

BRIEF DESCRIPTION OF THE DRAWINGS

Additional details and features of the disclosure are described with reference to the following figures in which.

DETAILED DESCRIPTION

Embodiments of the writing instrument according to the disclosure will be described with reference to the figures as follows.

Figure 1A:
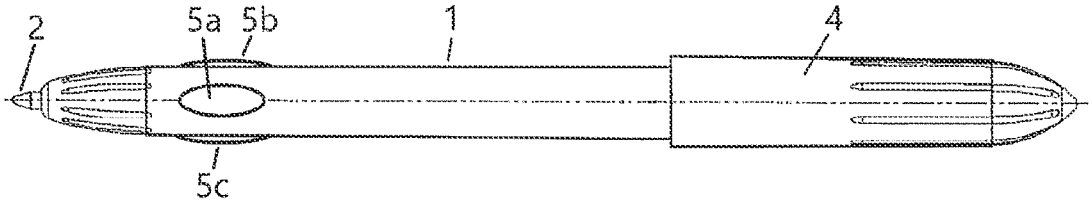
FIG. 1*a* shows a first embodiment of a writing instrument according to the present disclosure with three or four buttons to actuate pumping means.

FIG. 1*a* shows a first embodiment of a writing instrument or pen 1 according to the present disclosure with three buttons 5*a* to 5*c* to actuate three pumping means by means of at least one finger of a user. A fourth button 5*d* (not shown) on the reverse side of button 5*a* may be provided in order to activate a fourth pumping means 7*d* by means of at least one finger of a user.

The pumping means 7*a* to 7*c* are more specifically arranged directly below the buttons 5*a* to 5*c* and are designed to provide a pumping actuation by using a force or pressure exerted by the at least one finger. This means that the energy is introduced by pressing one or more buttons 5*a* to 5*c* to actuate the pumping means which are arranged below the respective button(s). For example, pressing button 5*a* only actuates a single pumping means for delivering a first ink or colorant of a first color from a first reservoir. On the other hand, if the user presses two buttons simultaneously, two pumping means for delivering first and second inks or colorants of first and second colors from first and second reservoirs is achieved for providing a mixture of these inks or colorants. Accordingly, all possibly mixtures of inks or colorants stored in three or four reservoirs are possible. The ink or colorant of a desired color or mixture of colors exits the writing instrument at the tip 2.

With that, it is possible to design a multiple color pen which does not comprise a micro-computer or a micro-chip for actuating and/or controlling the operation of the pumping means. As a result, a battery for such a micro-computer or a micro-chip is not needed either. However, it should be understood that a battery and a micro-computer or micro-chip may be present for other purposes, for example for actuating a laser and/or a lamp which may be included in the writing instrument.

Figure 2:
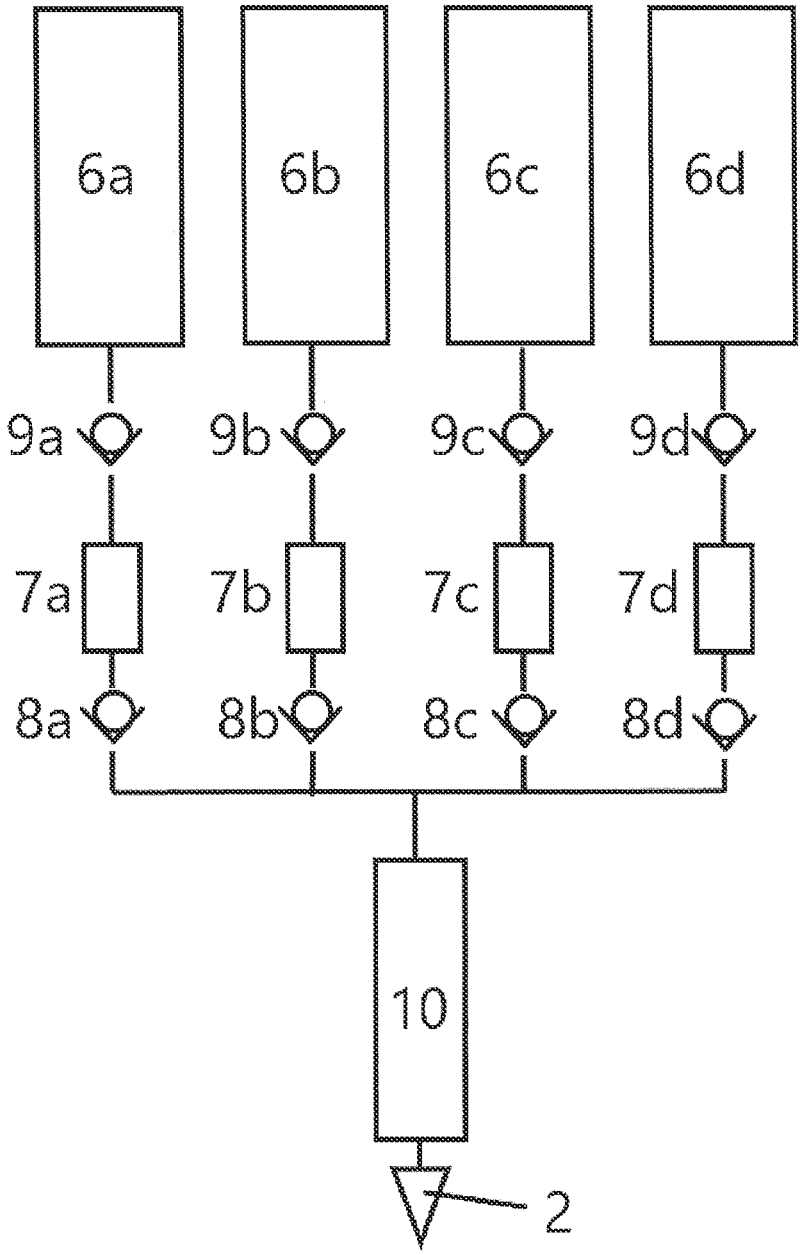
FIG. 2 is a schematic drawing showing components of a writing instrument of a first embodiment of the present disclosure.

FIG. 2 is a schematic drawing showing components of a writing instrument of a first embodiment of the present disclosure. The shown writing instrument or pen comprises four reservoirs 6*a* to 6*d*, each storing an ink or colorant of a different color. But as mentioned before, the writing instrument may comprise two, three or four reservoirs, each storing a colorant or ink of a different color. More specifically, the reservoirs separately store colorants or inks of the colors red, green, blue and/or black, respectively, or wherein the reservoirs separately store colorants or inks of the colors yellow, red, blue and/or black, respectively.

Pumping means 7*a*-7*d* are provided for pumping inks or colorants of a desired color into a mixing chamber 10. The mixing chamber 10 is designed to supply a single colorant/ink or to supply a mixture of colorants/inks of different colors, dependent on the actuation of the at least one finger of the user. The user may activate one, two, three or all pumping means 7*a*-7*d* simultaneously in order to select a desired color or mixture of colors. The ink or mixture of inks is provided over the mixing chamber 10 to the tip 2 of the writing instrument 1.

Each pumping means 7*a*-7*d* may comprise at least one valve, more specifically a self-actuated check valve (for blocking flow of ink/colorant in reverse direction). For example, as shown in FIG. 2, each pumping means 7*a*-7*d* may comprise a respective first valve, in particular a self-actuated first check valve 8*a*-8*d*, which is arranged between the pumping chamber of the respective pumping means 7*a*-7*d* and the mixing chamber 10. These valves are sufficient in order to achieve a pumping effect, because the backflow of ink/colorant towards the reservoirs is at least slightly blocked due to the thin fluid channels between the reservoirs and the pumping means. This means that an actuation of a pumping means in any event results in flow of ink/colorant through the respective first check valve 8*a*-8*d*. Alternatively or in addition, each pumping means 7*a*-7*d* may comprise a respective second valve, in particular a second self-actuated check valve 9*a*-9*d*, which is arranged between respective reservoir which is in fluid connection with the respective pumping means and the pumping chamber of the respective pumping means.

With the components of the first embodiment of the present disclosure as shown in FIG. 2, it is possible to activate the respective pumping means 7*a*-7*d* over the separate buttons 5*a* to 5*c* as shown in FIG. 1*a* (and over button 5*d* now shown in FIG. 1*a*, respectively). In this case, it is preferred to use colored buttons which correspond to the colors provided by the pumping means 7*a*-7*d* which are arranged below (radially within) the respective buttons.

Figure 3A:
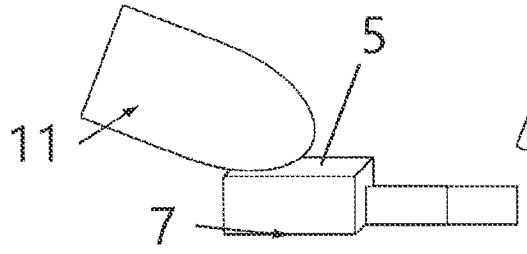
FIGS. 3*a* and 3*b* are schematic drawings showing the working principle of a preferred pump means of the present disclosure.
Figure 3B:
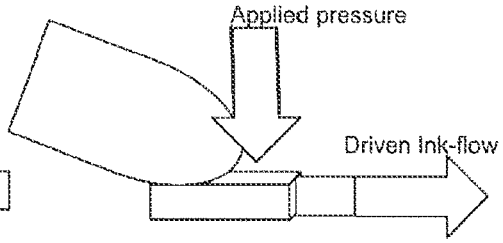

FIGS. 3*a* and 3*b* are schematic drawings showing the working principle of a preferred pumping means of the present disclosure. Before the user applies pressure over the button 5, the pumping means has a first volume (see FIG. 3*a*). When a user applies pressure by means of a finger 11, the volume of the pumping means is reduced to a second volume (see FIG. 3*b*) such that ink is delivered by the actuation of the finger.

Figure 4:
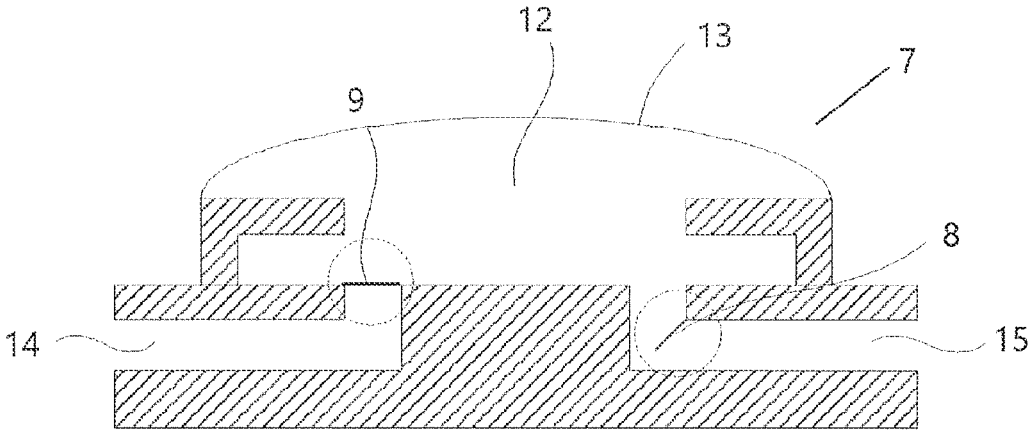
FIG. 4 shows a more detailed schematic drawing of a preferred pumping means of the present disclosure.

FIG. 4 shows a more detailed schematic drawing of a preferred pumping means 7 of the present disclosure. A pumping means 7 may comprise a pumping chamber 12 having a volume which can be reduced by using a force or pressure exerted by the at least one finger. A flexible membrane or element 13 may be provided which can be pressed into the pumping chamber 12 by a force or pressure exerted by the at least one finger. With that, each flexible membrane or element 13 changes its shape from a first shape to a second shape when a force or pressure is exerted by the at least one finger, thereby reducing the volume of the pumping chamber. When the volume of the pumping chamber 12 is reduced, ink or colorant flows over the check valve 8 to the fluid channel 15 which is connected to the mixing chamber. FIG. 4 shows the check valve 8 in its open position.

The flexible membrane or element 13 is more specifically designed to adopt its first shape after the force or pressure exerted by the at least one finger has been removed, thereby increasing or restoring the volume of the pumping chamber, in particular to its original volume prior to the actuation by at least one finger of a user. When the finger is removed, check valve 8 closes and blocks reverse flow into the chamber 12. Simultaneously, check valve 9 opens so that ink or colorant can flow from fluid channel 14 which is in connection with one of the reservoirs into the chamber 12.

A button 5 may be arranged directly over the flexible membrane or element 13. Alternatively, the flexible membrane or element 13 may be directly used as a button.

The pumping means may be manufactured from a plastic material either by injection molding or by a 3D printing process. The check valves 8, 9 and the flexible membrane or element 13 may be made of the same material. Alternatively, the check valves 8, 9 and/or the flexible membrane or element 13 may be made of a rubber material and/or a silicone material.

The fluid channels 14, 15 between the reservoirs and the at least one pumping means and the fluid channels between the pumping means and the mixing chamber preferable have a cross-section ranging from 0.01 to 0.25 $\mu m^2$, in particular from 0.05 to 0.2 $\mu m^2$.

Figure 5:
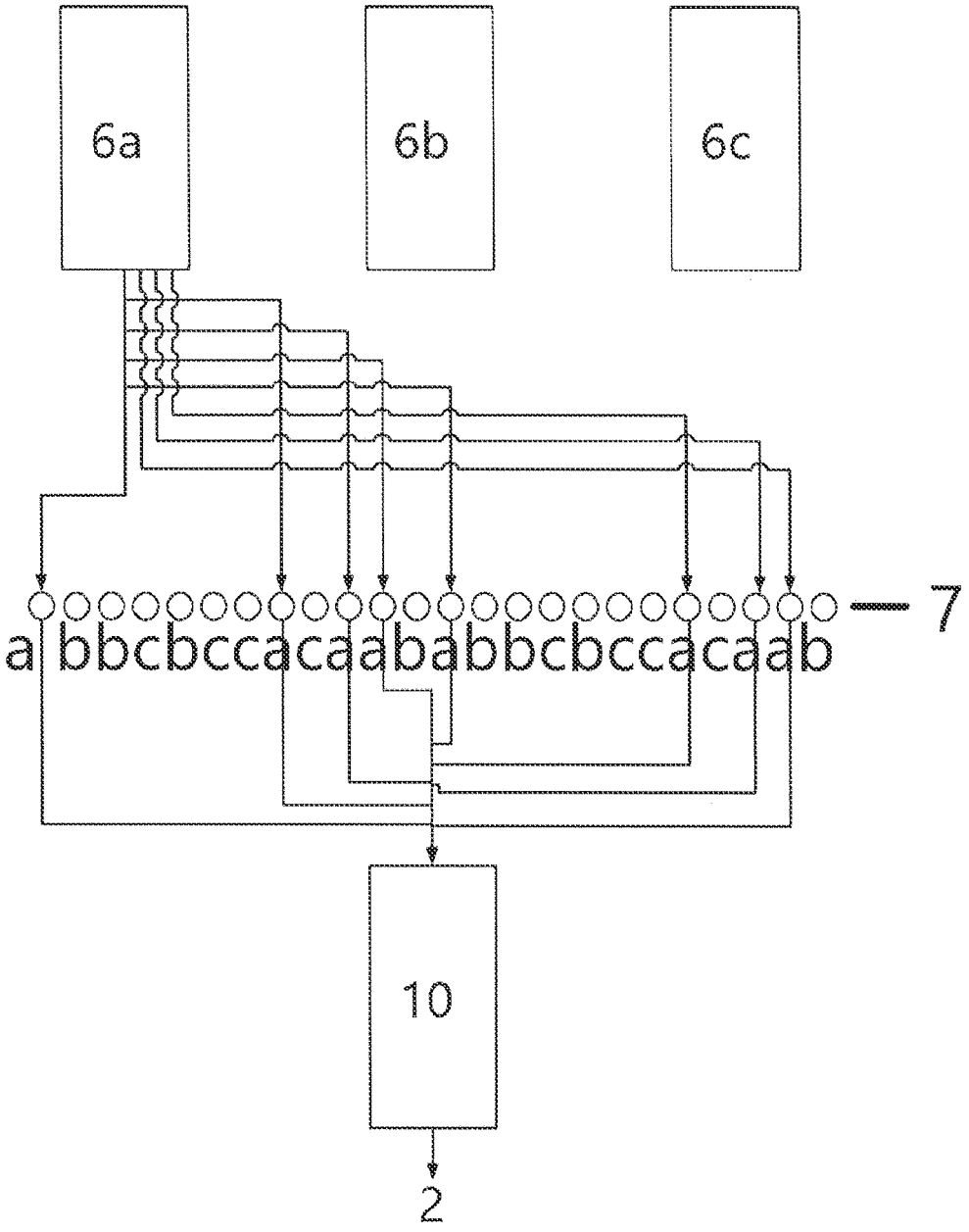
FIG. 5 is a schematic drawing showing components of a writing instrument of a second embodiment of the present disclosure.

FIG. 5 is a schematic drawing showing components of a writing instrument of a second embodiment of the present disclosure. The reservoirs 6*a*-6*c*, the mixing chamber 10 and the tip 2 may be identical compared to the previous embodiment. However, contrary to the previous embodiment, a plurality of pumping means 7 are provided, namely in total 24 pumping means 7, indicated by 24 circles in FIG. 5. Each reservoir 6*a*-*c* is in connection with a subgroup of the pumping means. As an example, reservoir 6*a* is in connection with the pumping means marked by the letter "a" in FIG. 5, i.e. all these pumping means deliver the color "a". Only the fluid channels connecting reservoir 6*a* to eight pumping means 7*a* is shown for sake of clarity. It should be understood that reservoir 6*b* also has fluid channels which are connected to eight other pumping means 7*b* for delivering color "b", and that reservoir 6*c* also has fluid channels which are connected to the remaining eight pumping means 7*c* for delivering color "c". Of courses, more or less pumping means may be used for each reservoir.

With such a design, it is possible to actuate a single button 5 which actuates two or three (or more) pumping means at the same time by means of a single finger. The pumping means and the buttons may be arranged circumferentially on the writing instrument. Typically more than three or four buttons 5 are used for this embodiment, for example 8 or 12. Alternatively, a single button surface may be used which extends over the entire circumference of the writing instrument at the axial position of the pumping means. A color indicator ring may be arranged directly neighboring to this single button surface which indicates to the user where the button surface should be actuated by means of a finger for achieving a certain color or mixture of colors.

Other arrangements of pumping means 7 compared to the arrangement shown in FIG. 5 are—of course—possible. For example, the pumping means may also be arranged in the sequence "aabbcc" with six finger actuation areas, each being designed for simultaneous actuation of two pumping means by a single finger, each finger actuation area being offset by the distance of one pumping means, so that the combinations "aa", "ab", "bb", "bc", "cc" and "ca" are possible. Alternatively, the pumping means may also be arranged in the sequence "aaabbbcccaabc" with ten finger actuation areas, each being designed for simultaneous actuation of three pumping means by a single finger, each finger actuation area being offset by the distance of one pumping means, so that the combinations "aaa", "aab", "abb", "bbb", "bbc", "bcc", "ccc", "cca", "caa" and "abc" are possible.

Figure 1B:
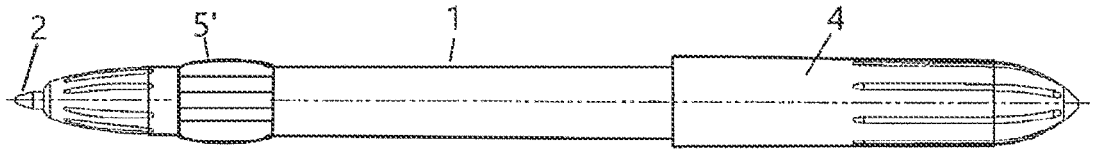
FIG. 1*b* shows another embodiment of a writing instrument according to the present disclosure.

With the components of the second embodiment of the present disclosure as shown in FIG. 5, it is possible to activate the respective pumping means 7 over a circumferentially extending actuation area 5' as shown in FIG. 1*b*. In this case, it is preferred to mark the respective finger actuation areas by means of sections marked by colors which are marked in FIG. 1*b* by means of axially extending lines on the actuation area 5'. The colors on the actuation area 5' correspond to the colors or mixture of colors provided by the pumping means which are arranged below (radially within) these marked sections.

Figure 6:
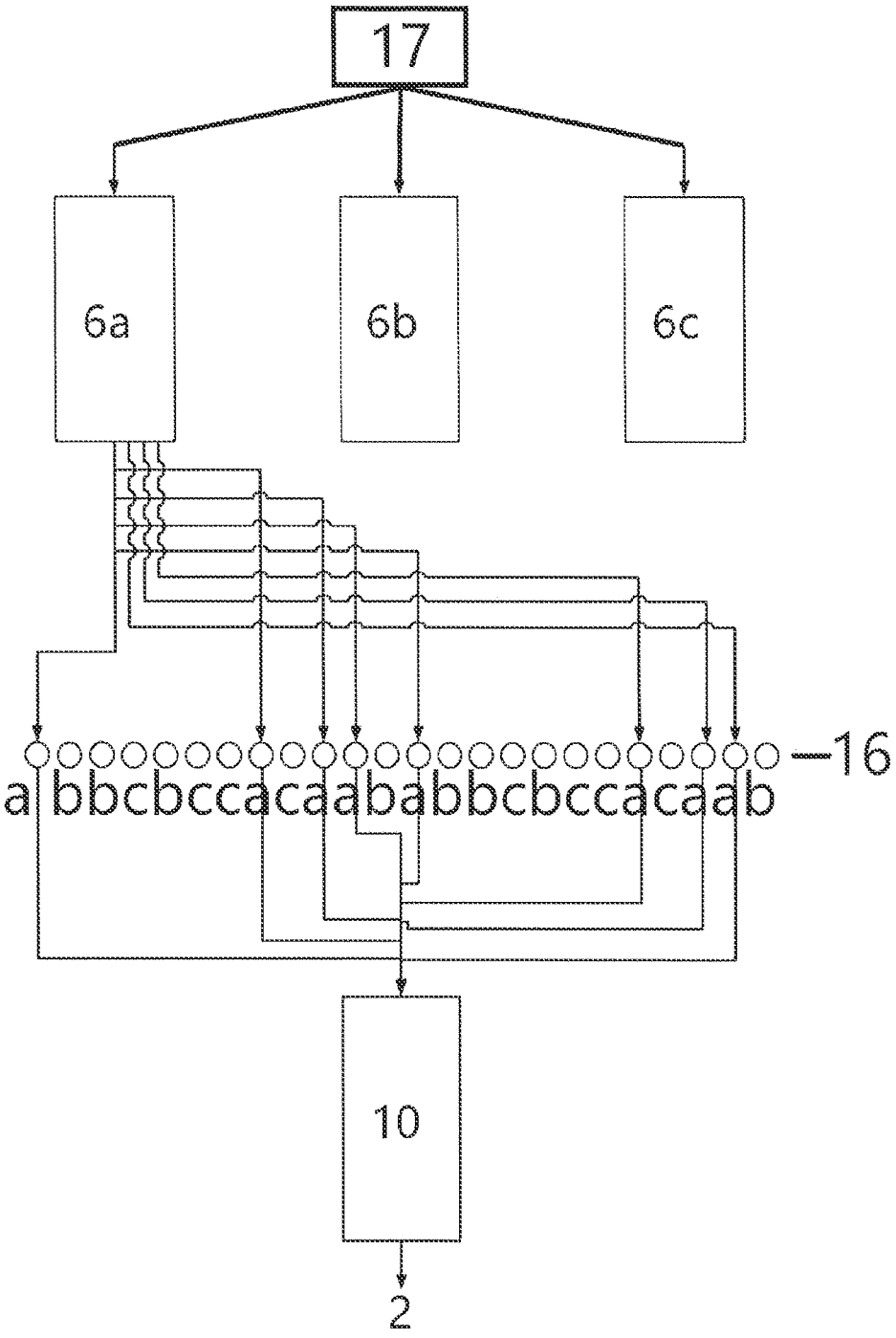
FIG. 6 is a schematic drawing showing components of a writing instrument of a third embodiment of the present disclosure.

FIG. 6 is a schematic drawing showing components of a writing instrument of a third embodiment of the present disclosure. Again, the reservoirs 6*a*-6*c*, the mixing chamber 10 and the tip 2 may be identical compared to the first and second embodiments. However, contrary to the second embodiment, a plurality of valves 16 are arranged between the reservoirs 6*a*-*c* and the mixing chamber 10. A pumping means 17 is in connection with the reservoirs 6*a*-*c* which has the purpose to increase the pressure within the reservoirs 6*a*-6*c*, in particular by pumping ambient air into the reservoirs 6*a*-6*c*. Therefore, the plurality of valves 16 can be selectively opened by the actuation of at least one finger in order to provide ink/colorant of a desired color or mixture of colors to the mixing chamber 10.

The plurality of valves 16, namely in total 24 valves 16, are indicated by 24 circles in FIG. 6. Each reservoir 6*a*-6*c* is in connection with a subgroup of the valves. As an example, reservoir 6*a* is in connection with the valves 16 marked by the letter "a" in FIG. 6, i.e. all these valves deliver the color "a". Only the fluid channels connecting reservoir 6*a* to eight valves 16*a* is shown for sake of clarity. It should be understood that reservoir 6*b* also has fluid channels which are connected to eight other valves 16*b* for delivering color "b", and that reservoir 6*c* also has fluid channels which are connected to the remaining eight valves 16*c* for delivering color "c". Of courses, more or less valves 16 may be used for each reservoir.

With the components of the third embodiment of the present disclosure as shown in FIG. 6, it is possible to activate the pumping means 17 over the cap 4. In particular, the cap 4 can be pushed in axial direction—for example by a thumb—to pump air into the reservoirs to increase the pressure in the reservoirs. The valves 16 may be actuated by means of a circumferentially extending finger actuation area 5' as shown in FIG. 1*b*, wherein sections of is this finger actuation area 5' may again be marked by colors indicating the colors or mixture of colors provided by the valves below the respective section.

Figure 1C:
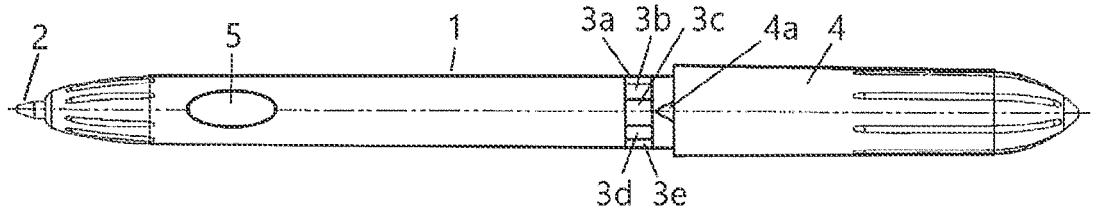
FIG. 1*c* shows another embodiment of a writing instrument according to the present disclosure.

Alternatively, the opening of the valves 16 can be controlled by rotating the cap 4 as shown in FIG. 1*c* around the longitudinal axis of the writing instrument. In this case, cap 4 may be connected to a ring which can rotate together with the cap 4, and wherein the ring has a single internal protrusion/cam or with multiple internal protrusions or cams which selectively engage valves 16. For example, a single internal protrusion/cam may open a single valve 16. However, it is also possible that a single internal protrusion/cam always opens two or three valves 16 in a certain rotational position of the cap 4. For example, if valves 16 are arranged in the sequence "aaabbbcccaabc", a single protrusion/cam may always open three valves, wherein all other valves remain closed. By rotating cap 4 the respective colors or mixture of colors, i.e. "aaa", "aab", "abb", "bbb", "bbc", "bcc", "ccc", "cca", "caa" and "abc" can be achieved by rotating the cap 4 in the respective position.

It is preferred to include a color indicator with colored sections 3*a*-3*e* as shown in FIG. 1*c* with a pointer 4*a* so that the user knows in which rotational position the cap 4 needs to be placed in order to achieve a desired color or mixture of colors to be delivered to the mixing chamber 10 (and finally to the writing surface over the tip 2).

In this case, it is preferred to provide an additional central valve to be actuated by a finger over the button 5 shown in FIG. 1*c*. This additional central valve may be arranged between the valves 16 and the mixing chamber 10 which are shown in FIG. 6, or between the mixing chamber 10 and the tip 2. With that, flow of ink or colorant through the valves 16 is generally only possible, if the user activates the central valve.

Figure 7:
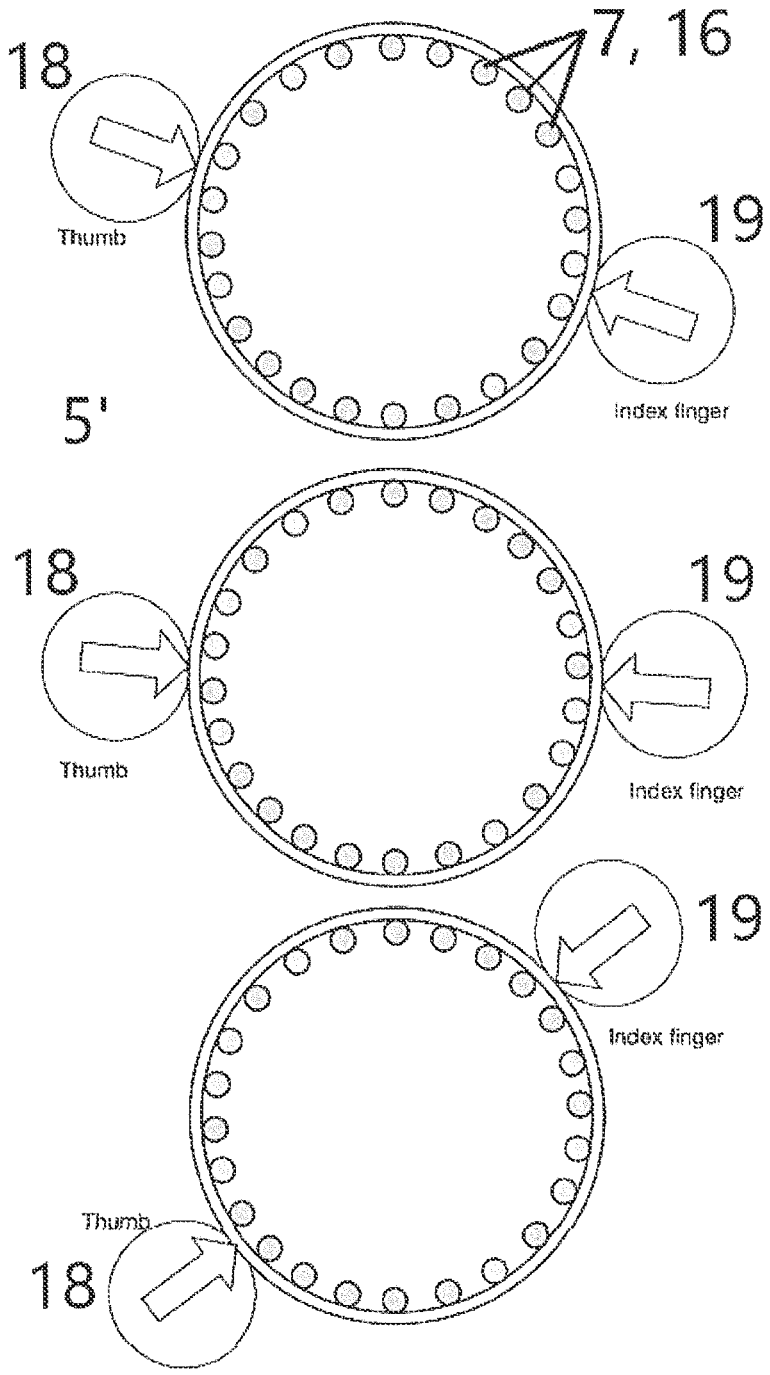
FIG. 7 shows an arrangement of multiple pumping means or valves positioned radially with in a circumferentially extending finger actuation area.

Multiple variations of the present disclosure are possible. For example, as shown in FIG. 7, multiple pumping means 7 or valves 16 (as described in context with FIGS. 5 and 6, respectively) may be positioned radially with in a circumferentially extending finger actuation area. The respective pumping means 7 or valves 16 may be actuated or activated for example by the thumb 18 and the index finger 19 of a user simultaneously to achieve a certain desired color or mixture of colors.

Figure 8:
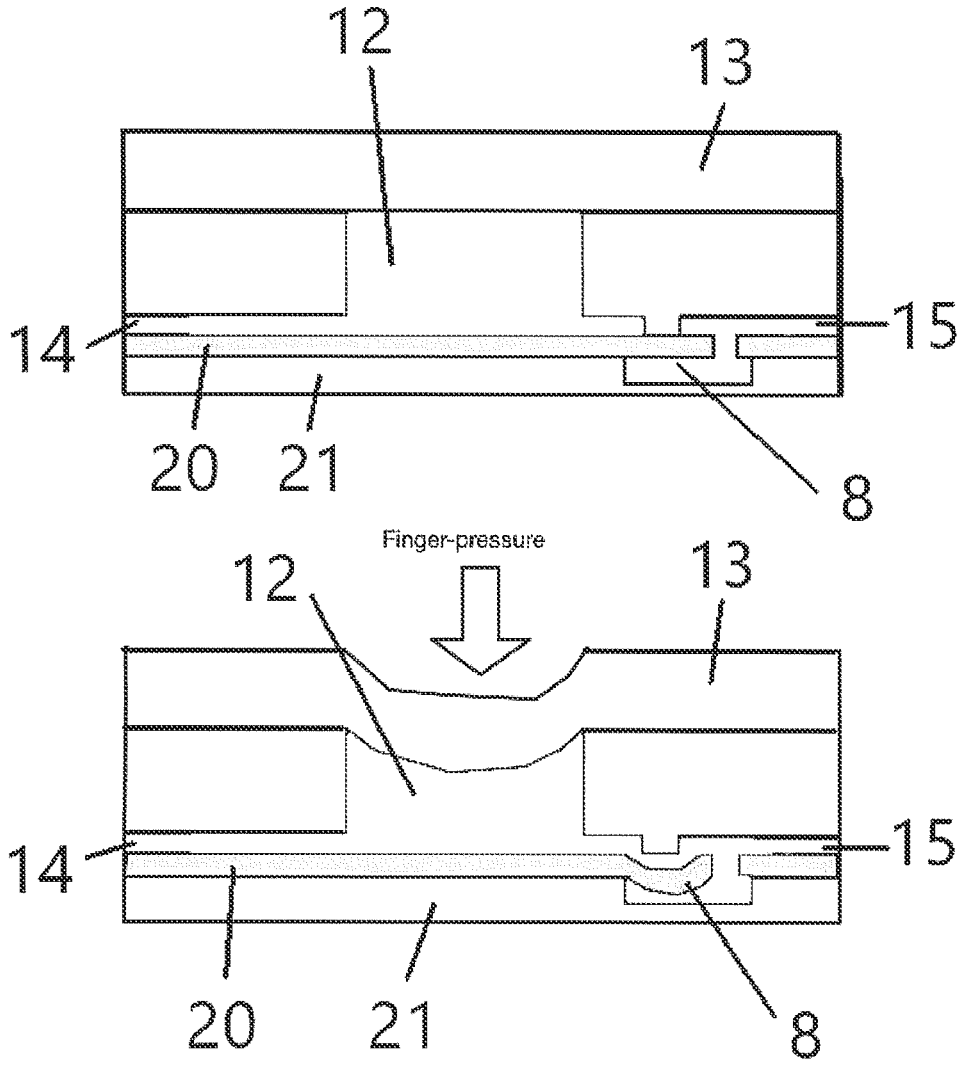
FIG. 8 shows schematic drawings of another working principle of a preferred pump means of the present disclosure.

The design of the pumping means may also be varied. For example, FIG. 8 shows schematic drawings of another working principle of a preferred pumping means of the present disclosure. The pumping chamber 12 is arranged below a flexible membrane or element 13 which may also serve as finger actuation area. The flexible membrane or element 13 can recover its original shape after the pressure applied by the finger has been removed. Before the user applies pressure over the button, the pumping means has a first volume (see upper drawing of FIG. 8). When a user applies pressure by means of a finger, the volume of the pumping means is reduced to a second volume (see lower drawing of FIG. 8) such that ink is delivered by the actuation of the finger. When the volume of the pumping chamber 12 is reduced, ink or colorant flows over the check valve 8 to the fluid channel 15 which is connected to the mixing chamber 10. When the finger is removed, check valve 8 closes and blocks reverse flow into the chamber 12.

In all embodiments of the present disclosure, the mixing chamber 10 may have a variable volume. With that, the amount of an ink/colorant mixture can be selected for a particular writing actuation (large volume in case of a longer writing actuation; small volume, if the writing instrument should be more responsive to a desired quicker change of color).

The fluid channels between the reservoirs and the at least one pumping means and the fluid channels between the pumping means and the mixing chamber preferable have a cross-section ranging from 0.01 to 0.25 $\mu m^2$, in particular from 0.05 to 0.2 $\mu m^2$.

The writing instrument may comprise two, three or four reservoirs, each storing a colorant or ink of a different color. More specifically, the reservoirs separately store colorants or inks of the colors red, green, blue and/or black, respectively, or wherein the reservoirs separately store colorants or inks of the colors yellow, red, blue and/or black, respectively.

Although the present disclosure has been described above and is defined in the attached claims, it should be understood that the disclosure may alternatively be defined in accordance with the following embodiments:

1. A writing instrument, in particular a pen, comprising at least two reservoirs for storing colorants or inks of at least two different colors, characterized by at least one pumping means which is designed to be actuated by at least one finger of a user.
2. A writing instrument according to embodiment 1, wherein the at least one pumping means is designed to provide a pumping actuation by using a force or pressure exerted by the at least one finger.
3. A writing instrument according to one of the preceding embodiments, wherein each pumping means comprises a pumping chamber having a volume which can be reduced by using a force or pressure exerted by the at least one finger.
4. A writing instrument according to one of the preceding embodiments, wherein each pumping means comprises a flexible membrane or element which can be pressed into the pumping chamber by a force or pressure exerted by the at least one finger.
5. A writing instrument according to one of the preceding embodiments, wherein each flexible membrane or element changes its shape from a first shape to a second shape when a force or pressure is exerted by the at least one finger, thereby reducing the volume of the pumping chamber.
6. A writing instrument according to one of the preceding embodiments, wherein the flexible membrane is designed to adopt its first shape after the force or pressure exerted by the at least one finger has been removed, thereby increasing or restoring the volume of the pumping chamber, in particular to its original volume prior to the actuation by at least one finger of a user.

7. A writing instrument according to one of the preceding embodiments, wherein each pumping means comprises at least one valve, more specifically two self-actuated check valves.
8. A writing instrument according to one of the preceding embodiments, comprising a mixing chamber which is designed to mix the different colors provided by the at least two pumping means.
9. A writing instrument according to one of the preceding embodiments, wherein each pumping means comprises a first valve, in particular a self-actuated first check valve, which is arranged between the pumping chamber of the pumping means and the mixing chamber.
10. A writing instrument according to one of the preceding embodiments, wherein each pumping means comprises a second valve, in particular a second self-actuated check valve, which is arranged between the reservoir which is in fluid connection with the pumping means, and the pumping chamber of the pumping means.
11. A writing instrument according to one of the preceding embodiments, wherein each pumping means is assigned to a single reservoir for providing a single colorant or ink stored in that reservoir.
12. A writing instrument according to one of the preceding embodiments, comprising a tip for applying a respective colorant or ink, or a mixture of colorants or inks onto a writing surface.
13. A writing instrument according to one of the preceding embodiments, wherein the tip is in fluid communication with the mixing chamber.
14. A writing instrument according to one of the preceding embodiments, wherein each reservoir is in fluid communication with multiple pumping means.
15. A writing instrument according to one of the preceding embodiments, comprising buttons or finger actuation areas, wherein at least part of these buttons or finger actuation areas are designed to actuate two or more pumping means by the force or pressure applied by a single finger.
16. A writing instrument according to one of the preceding embodiments, comprising a color indicator which indicates to a user which button or finger actuation area or which buttons or finger actuation areas need to be actuated for selecting a specific color or mixture of colors.
17. A writing instrument, in particular a pen, comprising at least two reservoirs for storing colorants or inks of at least two different colors, characterized by at least one pumping means which is designed to increase the pressure in the reservoirs.
18. A writing instrument according to embodiment 17, wherein each reservoir comprises at least one valve means arranged between the respective reservoir and a mixing chamber.
19. A writing instrument according to one of the preceding embodiments, wherein each valve means can be opened by using a force or pressure exerted by at least one finger.
20. A writing instrument according to one of the preceding embodiments, comprising a color selecting means which is designed to partially or fully open one or more valves.
21. A writing instrument according to one of the preceding embodiments, comprising an indicator means for indicating the position of the selecting means for selecting a specific color or mixture of colors, respectively.
22. A writing instrument according to one of the preceding embodiments, wherein the mixing chamber has a variable volume which can be varied by a user.
23. A writing instrument according to one of the preceding embodiments, wherein the fluid channels between the reservoirs and the at least one pumping means and the fluid channels between the pumping means and the mixing chamber have a cross-section ranging from 0.01 to 0.25 $\mu m^2$, in particular from 0.05 to 0.2 $\mu m^2$.
24. A writing instrument according to one of the preceding embodiments, wherein the writing instrument comprises two, three or four reservoirs, each storing a colorant or ink of a different color.
25. A writing instrument according to one of the preceding embodiments, wherein the reservoirs separately store colorants or inks of the colors red, green, blue and/or black, respectively, or wherein the reservoirs separately store colorants or inks of the colors yellow, red, blue and/or black, respectively.
26. A writing instrument according to one of the preceding embodiments, wherein the writing instrument does not comprise a micro-computer or a micro-chip for actuating and/or controlling the operation of the pumping means.
27. A writing instrument according to one of the preceding embodiments, wherein the writing instrument does not comprise a battery for such a micro-computer or a micro-chip.

The invention claimed is:

1. A writing instrument, comprising:

at least two reservoirs for storing colorants or inks of at least two different colors;

at least two pumps, wherein each of the at least two reservoirs is coupled to at least one of the two pumps, wherein each pump is designed to be actuated by at least one finger of a user; and buttons or finger actuation areas;

wherein at least part of these buttons or finger actuation areas are designed to actuate two or more pumps by the force or pressure applied by a single finger.

2. The writing instrument according to claim 1, wherein each pump comprises a pumping chamber having a volume which can be reduced by using a force or pressure exerted by the at least one finger.

3. The writing instrument according to claim 2, wherein each pump comprises a flexible membrane or element which can be pressed into the pumping chamber by a force or pressure exerted by the at least one finger.

4. The writing instrument according to claim 3, wherein each flexible membrane or element changes its shape from a first shape to a second shape when a force or pressure is exerted by the at least one finger, thereby reducing the volume of the pumping chamber.

5. The writing instrument according to claim 4, wherein the flexible membrane is designed to adopt its first shape after the force or pressure exerted by the at least one finger has been removed, thereby increasing or restoring the volume of the pumping chamber.

6. The writing instrument according to claim 5, wherein the volume of the pumping chamber is restored to its original volume prior to the actuation by at least one finger of a user.

7. The writing instrument according to claim 1, wherein each pump comprises at least one valve.

8. The writing instrument according to claim 1, wherein each of the pumps comprises at least one self-actuated check valve, the writing instrument further comprising a mixing chamber which is designed to mix the different colors provided by the at least two pumps through the self-actuated check valves.

9. The writing instrument according to claim 1, wherein each pump comprises a first valve, which is arranged between the pumping chamber of the pump and the mixing chamber.

10. The writing instrument according to claim 9, wherein the first valve is a self-actuated first check valve.

11. The writing instrument according to claim 1, wherein each pump comprises a second valve, which is arranged between the reservoir which is in fluid connection with the pump, and the pumping chamber of the pump.

12. The writing instrument according to claim 1, wherein each pump is assigned to a single reservoir for providing a single colorant or ink stored in that reservoir.

13. The writing instrument according to claim 1, comprising a color indicator which indicates to a user which button or finger actuation area or which buttons or finger actuation areas need to be actuated for selecting a specific color or mixture of colors.

14. The writing instrument according to claim 1, wherein an outlet of at least one of the at least two pumps is sealed by a valve means and each valve means can be opened using a force or pressure exerted by at least one finger.

15. The writing instrument according to claim 1, comprising a color selecting means which is designed to partially or fully open one or more valves.

16. The writing instrument according to claim 1, further comprising a mixing chamber, and wherein the mixing chamber has a variable volume.

17. The writing instrument according to claim 16, wherein the mixing chamber has a volume which can be reduced by using a force or pressure exerted by the at least one finger.

18. The writing instrument according to claim 1, wherein each pump comprises two self-actuated check valves.

19. A writing instrument comprising at least two reservoirs for storing colorants or inks of at least two different colors, characterized by at least two pumps which are designed to increase the pressure in the reservoirs, wherein the writing instrument is a pen, wherein the pen further comprises buttons or finger actuation areas and at least part of the buttons or finger actuation areas are designed to actuate two or more pumps by the force or pressure applied by a single finger.

20. The writing instrument according to claim 19, wherein the writing instrument comprises two, three or four reservoirs, each storing a colorant or ink of a different color.

* * * * *